US006308036B1

(12) United States Patent
Taniyama et al.

(10) Patent No.: US 6,308,036 B1
(45) Date of Patent: Oct. 23, 2001

(54) IMAGE FORMING SYSTEM WITH WASTE TONER CONTAINER AND RESTRAINT MEMBER

(75) Inventors: Yoshiharu Taniyama, Kawasaki; Shinichi Itoh, Yokohama, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,919

(22) Filed: Feb. 18, 2000

(51) Int. Cl.[7] ..... G03G 15/08; G03G 21/12
(52) U.S. Cl. ..... 399/262; 399/358; 399/360
(58) Field of Search ..... 399/12, 13, 27, 399/35, 120, 262, 358, 360

(56) References Cited

U.S. PATENT DOCUMENTS 5,541,715 * 7/1996 Katoh et al. ..... 399/358 X
5,589,915 * 12/1996 Hashimoto ..... 399/120
5,737,668 * 4/1998 Johroku ..... 399/120

FOREIGN PATENT DOCUMENTS 11-327272 11/1999 (JP) .

* cited by examiner

*Primary Examiner*—William J. Royer
(74) *Attorney, Agent, or Firm*—Foley & Lardner

(57) ABSTRACT

An image forming system has a developing device for causing a toner to adhere to a latent image, which is formed on a photosensitive material drum, to form a visible image; a toner supply device for supplying a toner, which is housed in a toner receiving container, to the developing device; a toner removing device for removing a remaining toner after the visible image on the photosensitive material drum is transferred to a transfer paper; and a waste toner container for accumulating therein a waste toner removed by the toner removing device, and the waste toner container has a restraint member for enabling attaching and detaching said toner container when said toner container and said waste toner container are in their special positional relation.

13 Claims, 5 Drawing Sheets

IMAGE FORMING SYSTEM WITH WASTE TONER CONTAINER AND RESTRAINT MEMBER

BACKGROUND OF THE INVENTION

1. Field of the Invention

The present invention relates generally to an information forming system having a toner recovering function of recovering a toner remaining on a surface of a photosensitive material drum after transferring an image to a paper, a waste toner container for accumulating a recovered waste toner, and a toner receiving container used in connection with the recovery of the toner.

2. Description of the Related Background Art

In image forming systems, such as copying machines, facsimiles and printers, a photosensitive material drum is electrified to be exposed in accordance with an image, and a toner is absorbed onto the photosensitive material drum to carry out developing for forming a visible image. After this visible image is transferred to a transfer paper, fixing is carried out by heating, so that a desired copy is obtained.

After the transfer to the transfer paper, excessive toner remains on the photosensitive material drum. Since such a toner remaining on the photosensitive material drum has an adverse influence on the next copying, the remaining toner must be completely removed.

In order to remove such a remaining toner after fixing, a cleaner is conventionally provided. This cleaner has a de-electrifier for de-electrifying the photosensitive material drum before cleaning, and a blade for raking down the toner on the photosensitive material drum. The toner removed by the de-electrifier and the blade is housed in a container called a waste toner box. These are known generally as a toner recovery unit.

A conventional waste toner box must have a sufficient size since a waste toner introduced into the toner box via an inlet naturally drops to accumulate therein. There is a problem that such large size of the waste toner box obstructs downsizing and in turn cost reducing.

On the other hand, toners supplied to image forming systems have been improved as important components for enhancing the quality of an image, and manufacturers have provided the optimum toners for the design specification of their systems as genuine products (which will be hereinafter referred to as "certified products").

In recent years, toners meeting the minimum specifications common to image forming systems commercially available from a plurality of manufacturers are in circulation. There is a problem in that such toners meeting only a part of specifications (which will be hereinafter referred to as "uncertified toners" generally have inferior image quality and have a bad influence on a photosensitive material drum serving as an image carrier and a developing part, to adversely effect the reliability of the systems.

A typical toner is generally housed in a container to be provided. Conventionally, although toners have been sometimes improved to be easily handled, toners have not often been improved to recommend the certified products.

In particular, although the above described waste toner box is closely related with a toner cartridge, the waste toner box and the toner cartridge are separately attached or exchanged, and there is a problem in that the waste toner box can be used whether the toner cartridge is a certified product or an uncertified product.

Furthermore, conventionally, in many cases, a toner cartridge and a waste toner box integrated. However, since the toner cartridge and the waste toner box are arranged so that their directions are perpendicular, there is also another problem that its packing size becomes large.

SUMMARY OF THE INVENTION

It is therefore an object of the present invention to provide an image forming system which uses a waste toner container capable of being downsized and having small packing capacity and which has a toner recovery function.

It is another object of the present invention to provide a waste toner container which urges a user to use a certified toner container.

According to the first aspect of the invention, there is provided an image forming system comprising: an image forming system comprising:

a developing device for causing a toner to adhere to a latent image, which is formed on a photosensitive material drum, to form a visible image;

a toner supply device for supplying a toner, which is housed in a toner receiving container, to said developing device;

a toner removing device for removing a remaining toner after said visible image on said photosensitive material drum is transferred to a transfer paper;

a waste toner container for accumulating therein a waste toner removed by said toner removing device; and a restraint member for enabling attaching and detaching said toner container when said toner container and said waste toner container are in their special positional relation.

According to the second aspect of the present invention, there is provided a waste toner container for use in an image forming system comprising: a developing device for causing a toner to adhere to a latent image, which is formed on a photosensitive material drum, to form a visible image; a toner supply device for supplying a toner, which is housed in a toner receiving container, to said developing device; and a toner removing device for removing a remaining toner after said visible image on said photosensitive material drum is transferred to a transfer paper, said waste toner container accumulating therein a waste toner removed by said toner removing device, wherein said waste toner container has a restraint member for blocking movement of the toner container which has been in a predetermined position, when said waste toner container is attached in a predetermined position.

According to the third aspect of the present invention, there is provided a toner container for use in an image forming system comprising: a developing device for causing a toner to adhere to a latent image, which is formed on a photosensitive material drum, to form a visible image; a toner supply device for supplying a toner, which is housed in a toner receiving container, to said developing device; and a toner removing device for removing a remaining toner after said visible image on said photosensitive material drum is transferred to a transfer paper, said waste toner container accumulating therein a waste toner removed by said toner removing device, wherein said toner container has a restraint member which its movement is blocked by a blocking member of the waste container when the toner container has been in a predetermined position.

According to the fourth aspect of the present invention, there is provided a toner container for use in a toner supply unit for supplying toner to an image forming system for forming arbitrary image including characters and figures, wherein detaching of said toner container is blocked by a waste toner container for accumulating excessive toner in the image forming system, when the toner container is attached to the toner supply unit.

DESCRIPTION OF THE PREFERRED EMBODIMENTS

Referring now to the accompanying drawings, the preferred embodiments of the present invention will be described below.

Figure 1:
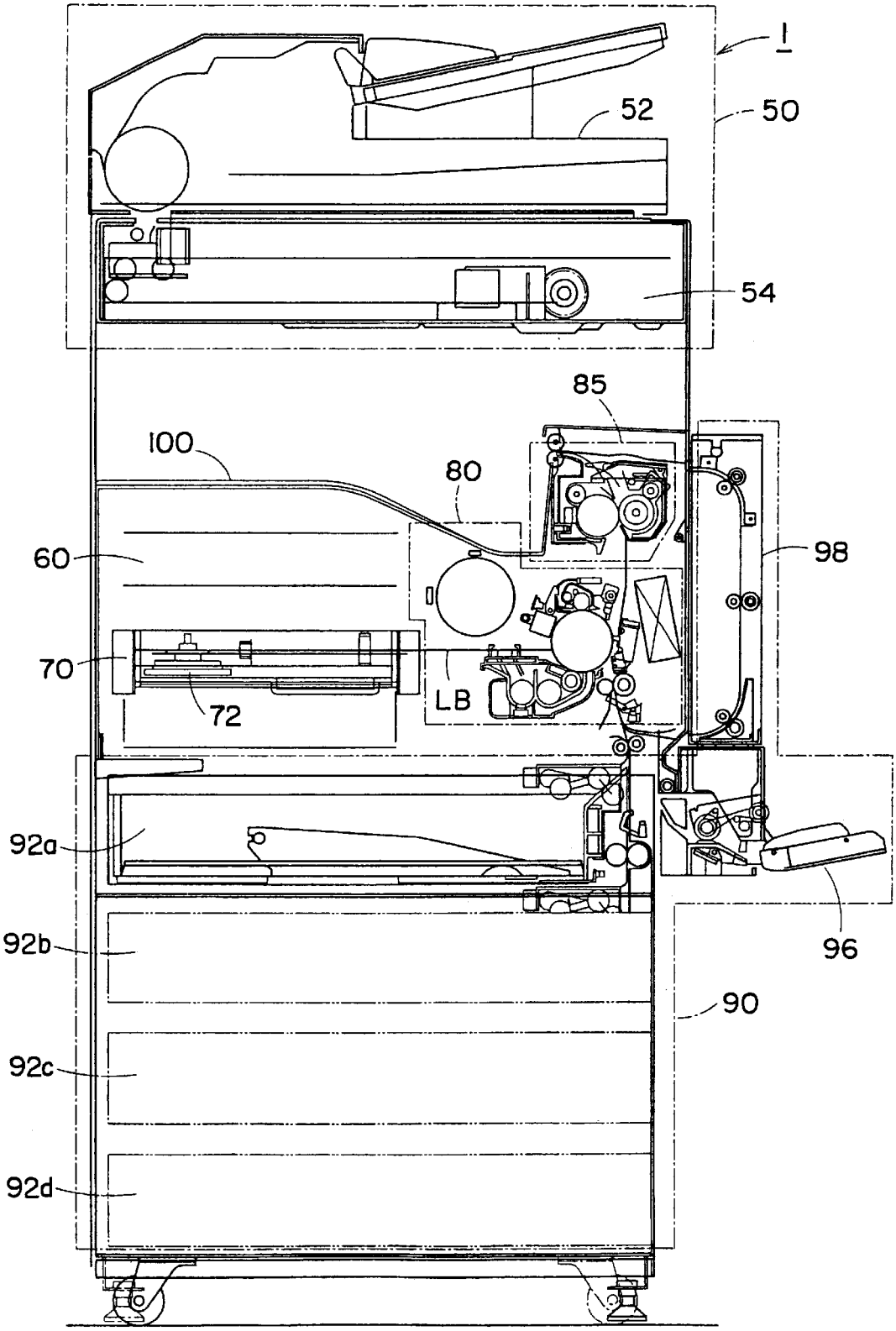
FIG. 1 is a schematic diagram showing an example of a copying machine serving as an image forming system according to the present invention.

FIG. 1 is a front perspective view schematically showing the construction of an example of an image forming system, to which a toner recovery device according to the present invention is applied.

A copying machine shown in FIG. 1 is a plain paper copier of a digital system for once converting image information, which is acquired by optical means, into image data to produce laser beams on the basis of the image data to scan a photosensitive material drum.

As shown in FIG. 1, the copying machine 1 comprises an image reading part 50 provided in the upper portion of the machine body thereof, an image storing part 60 provided in the middle portion of the machine body, a laser unit 70, an image forming part 80, a fixing part 85 and a paper feeding part 90.

The paper feeding part 90 includes a plurality of stages of paper feeding units 92*a* through 92*d*, a manual paper feeding tray 96 and a double face unit 98. The paper feeding units 92*a* through 92*d* are provided in the bottom portion of the machine body, and house therein a large number of sheets, on which images are transferred. Although plain papers are usually used as the sheets, tracing papers and OHP films may be used. The manual paper feeding tray 96 is provided in the vicinity of the image forming part 80 on the right side of the machine body, so that sheets having sizes other than the Japanese Industrial Standard sizes, and thick papers such as postal cards can be manually fed. The double face unit 98 is provided on the right side in the middle portion of the machine body, and turns a sheet, which has once passed through the image forming part 80 and to one face of which an image has been transferred, over to feed the sheet to the image forming part 80 again to copy images on both sides of the sheet.

The image reading part 50 includes a scanner 54 and an automatic document feeding unit 52. The scanner 54 reads the image of a manuscript and converts the image into image data. The automatic document feeding unit 52 feeds a sheet manuscript into the scanner 54.

The image storing part 60 stores therein image data supplied from the scanner 54. The laser unit 70 has a plurality of semiconductor laser oscillators (not shown) and a polygon mirror 72. The image data are taken out from the image storing part 60, and the semiconductor laser oscillators are caused to emit laser beams LB, which are reflected on the polygon mirror 72 to scan on the image forming part 80.

Figure 2:
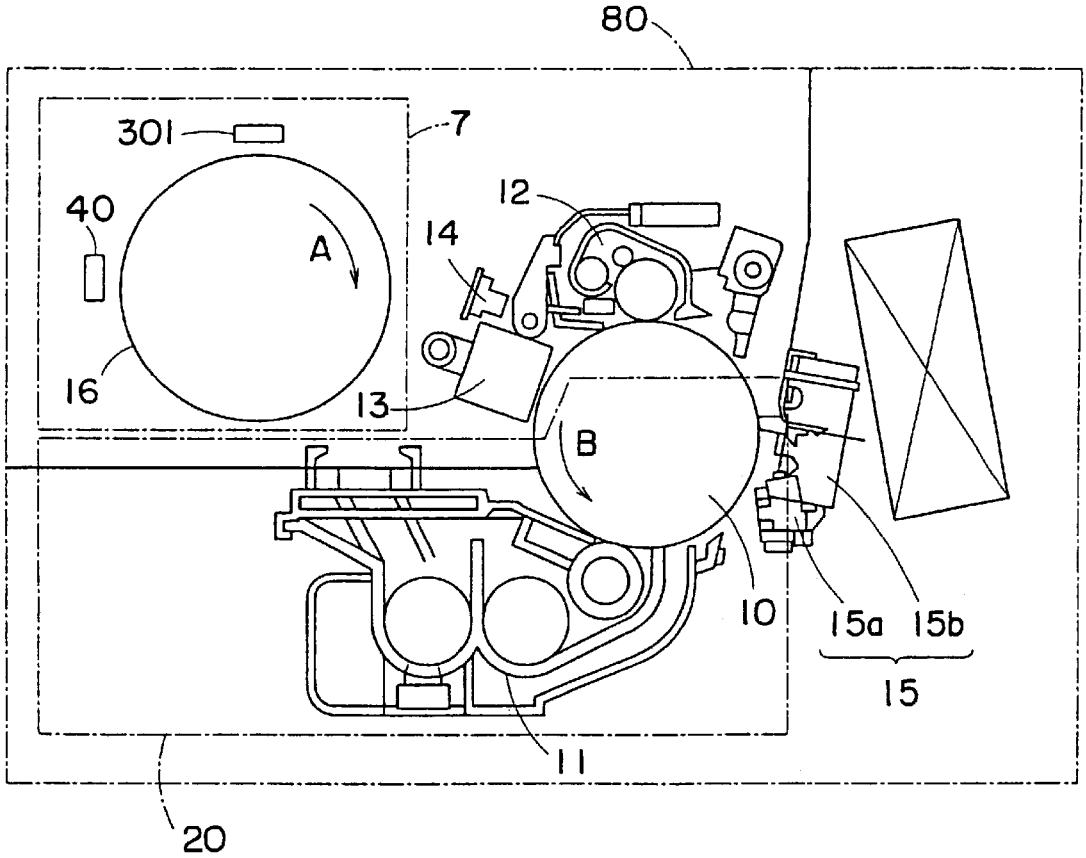
FIG. 2 is an enlarged view of an image forming part of the copying machine of FIG. 1.

FIG. 2 is an enlarged front view showing a principal part of the image forming part 80.

In the following description, the same reference numerals are given to elements which are the same as those in FIG. 1 and their detailed descriptions will be omitted.

As shown in this figure, the image forming part 80 comprises a photosensitive material drum 10, an electrification charger 13, a developing device 11, a transfer/peeling charger 15, a drum cleaner 12, a de-electrifying lamp 14, and a toner supply device 7 in this preferred embodiment.

During a developing operation, the photosensitive material drum 10 rotates counterclockwise B.

The image forming part 80 shown in FIG. 2 adopts a reverse developing system. In the image forming part 80, when the electrification charger 13 electrifies electric charges of a negative polarity on the photosensitive material drum 10 and when the photosensitive material drum 10 is exposed to the laser beams LB emitted from the laser unit 70, the surface potential of the photosensitive material drum 10 in a region corresponding to the image portion of the manuscript approaches zero in accordance with the density of the image to form a latent image.

The copying machine 1 adopts a two-component system. The developing device 11 houses therein a carrier and a toner. The toner is supplied to the developing device 11 so as to have a percentage of about 5% to the carrier of about 95%. The amount of the toner is always monitored by a magnetic sensor (not shown) or the like. If the percentage of the toner in the developing device 11 falls below 5%, a toner supply part 18, which will be described later, of the toner supply device operates to supply a required amount of toner to the developing device 11. The carrier and the toner are agitated in the developing device 11, so that electric charges of a negative polarity are applied to the toner by the frictional electrification during agitation. When the latent image arrives above the developing device 11 by the rotation of the photosensitive material drum 10, the toner is absorbed onto the photosensitive material drum 10 via the carrier to form a visible image. The visible image is carried from the paper feeding part 90 to be transferred to a sheet which is previously electrified to a positive polarity by a transfer charger 15*a*. Immediately after the transfer, positive charges are removed from the sheet by a peeling charger 15*b*, to which the image has been transferred, and then, the sheet is carried to the fixing part 85. The fixing part 85 causes the toner to fuse and adhere to the sheet by thermo compression bonding, and carries the sheet to a paper discharging tray 100 (see FIG. 1).

The toner which has not been transferred to the sheet and which remains on the surface of the photosensitive material drum 10, together with paper powder adhering to the toner from the sheet, is removed by the drum cleaner 12. The remaining charges of the photosensitive material drum 10 are removed by the de-electrifying lamp 14.

A waste toner box 20 shown by an imaginary line for accumulating the toner removed by the drum cleaner is provided on the front side. This waste toner box 20 will be described later.

The toner supply device 7 comprises a substantially cylindrical toner cartridge 16, an optical sensor 40 for reading a discriminating label (not shown) including information relating to the toner cartridge specification and being adhered on the peripheral surface of the cylinder and a cleaning part 301 for cleaning the discrimination label prior to the reading. The discriminating label has a width of 10 to 20 mm and is applied to extend in rotational directions of the toner cartridge 16. The discrimination label has information relating to the toner cartridge 16, for example, the fact that the toner cartridge 16 is a certified product, the type and destination (countries and regions on the market, and OEM provided manufacturers) of machines, on which the toner cartridge 16 is attached, the capacity of the container, the material and components of the toner, and color of the toner when the toner cartridge 16 is used for a color copying machine or a color printer. The information is recorded in the form of a bar code.

The toner cartridge 16 has a spiral protruding portion (not shown) on the inner peripheral surface. As a result of the formation of the protruding portion, a spiral groove 16*a* appears on the surface thereof. As described above, the toner cartridge 16 is driven by a rotating unit 19 to rotate clockwise A (a second rotational direction) to move the inside toner toward the tip portion (the inside portion viewed from the front of the machine body) to discharge the toner via a toner supply hole 17, which is provided at the tip portion, to supply the toner into the developing device 11.

Figure 3A:
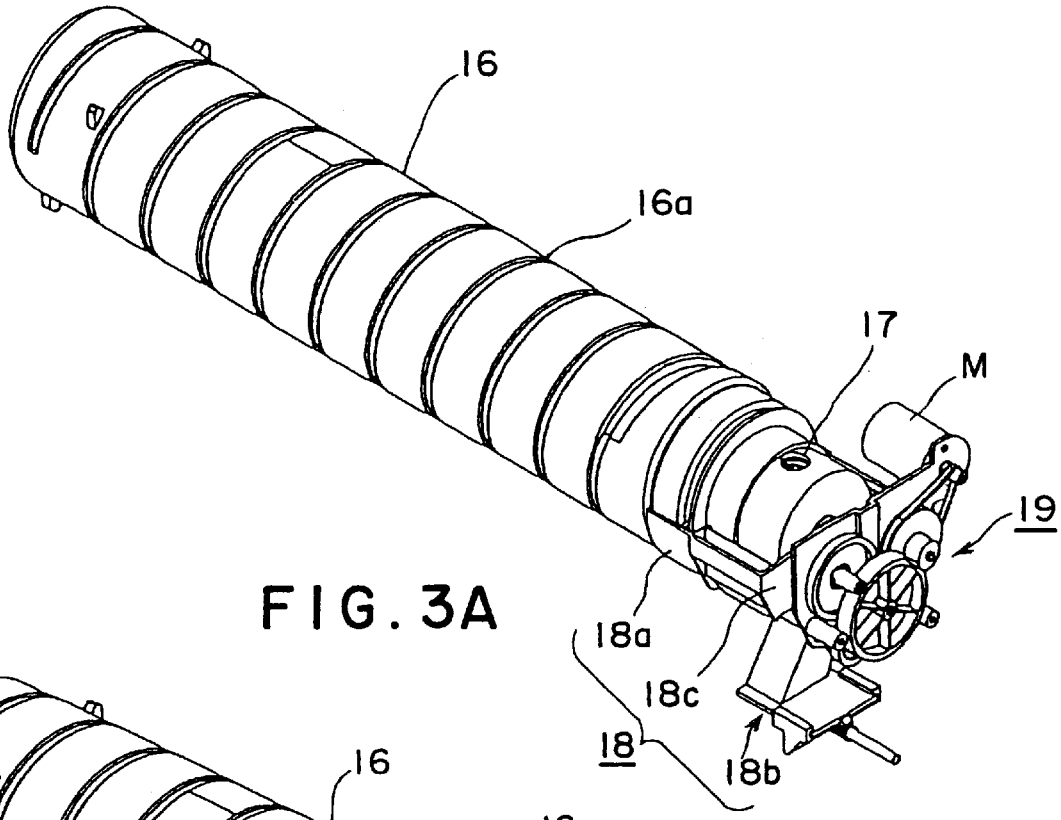
FIGS. 3A and 3B are schematic perspective views showing the construction of a principal part of a toner supply device of the copying machine of FIG. 1.
Figure 3B:
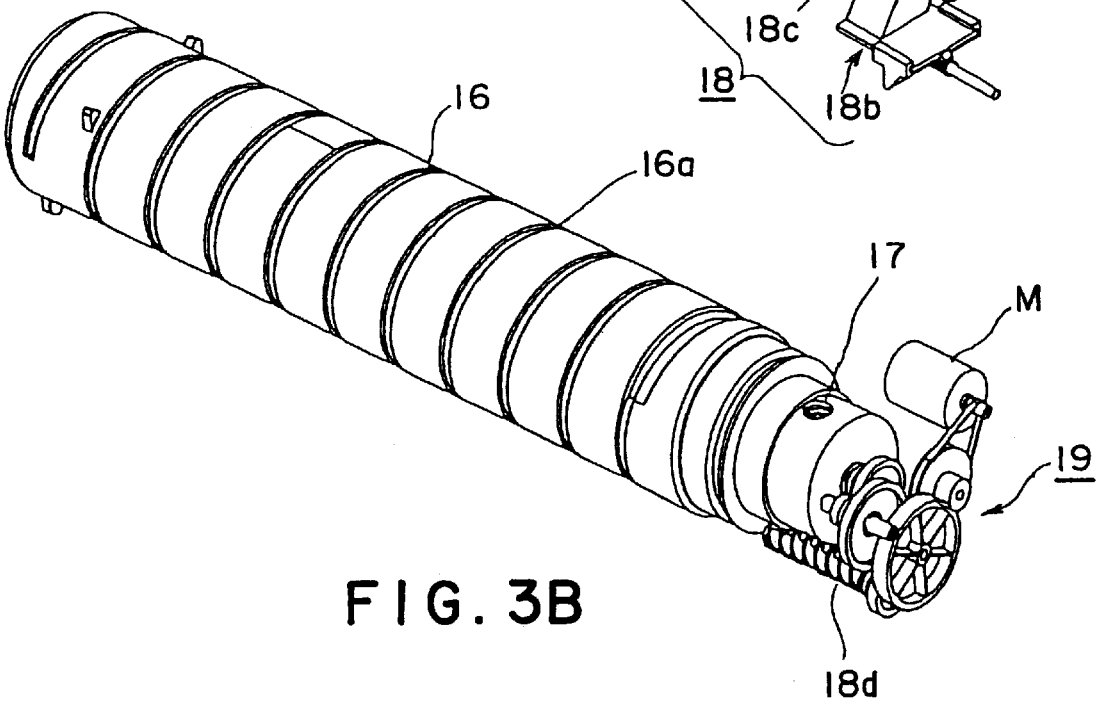

Referring to FIGS. 3A and 3B, the detailed construction of the toner supply device 7 will be described below.

FIG. 3A is a schematic perspective view of the toner supply device 7, and shows the state that the toner cartridge 16 is inserted along a guide (not shown) to be loaded in the toner supply device 7.

The toner cartridge 16 has a substantially cylindrical shape, and the toner supply hole 17 is formed in the peripheral surface of the tip portion of the toner cartridge 16. When the cartridge is attached, the tip portion thereof is pressed into the holder 18*a* of the toner supply part 18 to be connected to a rotating unit 19 which is mounted on the supporting plate 18*c* and which includes a drive motor M, a belt drive mechanism for reduction, and a gear drive mechanism. The toner supply part 18 also has a guiding portion 18*b* for guiding the supplied toner to the developing device 11.

FIG. 3B more clearly shows the drive mechanism by imaginary removing the holder 18*a*, the guiding portion 18*b* and the supporting plate 18*c* from FIG. 3A. There is shown a carrier auger 18*d* for temporarily holding the toner, which is discharged from the supply hole 17, to guide the toner to the guiding portion 18*b*.

The operation of the toner supply device will be described below.

The rotating unit 19 receives a command from a control part (not shown), to rotate the toner cartridge 16 counterclockwise B (a first rotational direction) or clockwise A. By this rotation operation, the toner housed in the toner cartridge 16 is agitated. At this time, by the clockwise rotation and by the spiral shape in the toner cartridge, the toner moves toward the toner supply hole 17 at the tip portion while being agitated.

The toner discharged from the toner supply hole 17 is temporarily stored in the carrier auger 18*d* of the toner supply part 18. The toner carried by driving the carrier auger 18*d* is supplied from the guiding portion 18*b* to the developing device 11.

Figure 4:
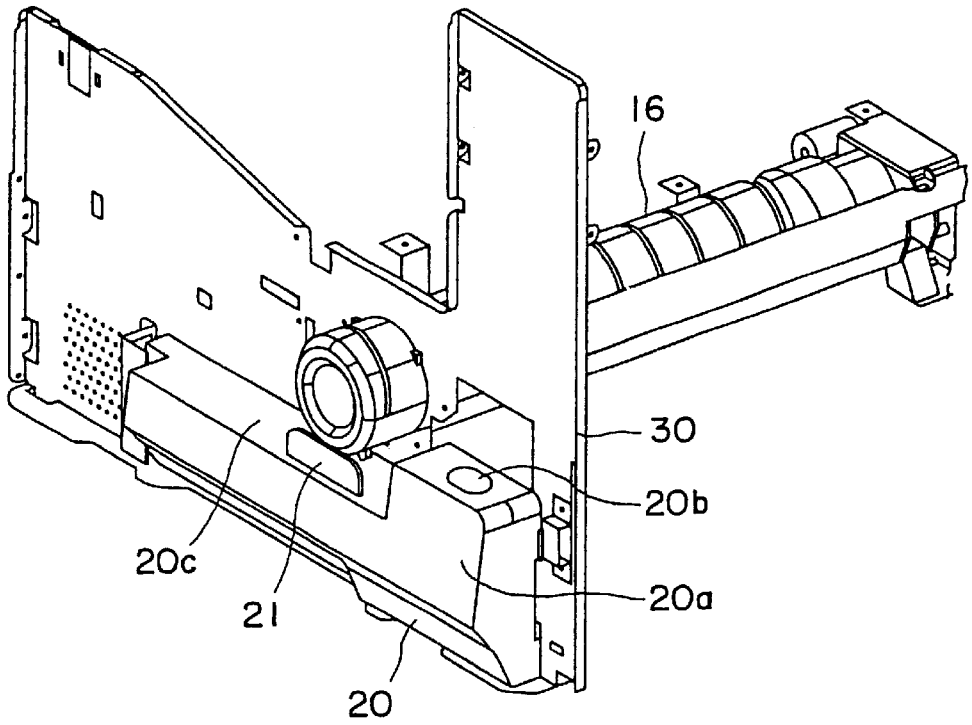
FIG. 4 is a schematic perspective view showing the construction of a part related to a toner recovery operation serving as a principal part of the present invention.

FIG. 4 is a partially broken-out perspective view showing the mounting state of the waste toner box and the relation between the waste toner box and the toner cartridge, which is viewed from the front side of the copier.

A frame 30 for supporting the opposite end portion to the tip portion of the toner cartridge 16 on a through opening formed therein is provided on the front side of the copying machine body. The waste toner box 20 is mounted below the end portion of the toner cartridge 16 which passes through the frame 30 to protrude.

The waste toner box 20 has a laterally elongated flat box shape. Only a right end portion 20*a* of the waste toner box 20 rises so as to approach the above-described cleaner 12. An opening 20*b* is formed in the top of the right end portion 20*a*. The toner raked down by the blade of the cleaner 12 shown in FIG. 2 is introduced into the opening 20*b* by means of a suitable guiding portion (not shown) to be housed in the waste toner box 20.

On the top surface 20*c* of the waste toner box 20 at a position corresponding to the toner cartridge 16, a blocking plate member 21 is provided so as to be positioned on the front side of the tip portion of the toner cartridge 16. Since the blocking plate member restricts the movement of the toner cartridge 16 toward the front side while the waste toner box 20 is attached, it is impossible to detach or exchange only the toner cartridge 16 without detaching the waste toner box 20.

Figure 5:
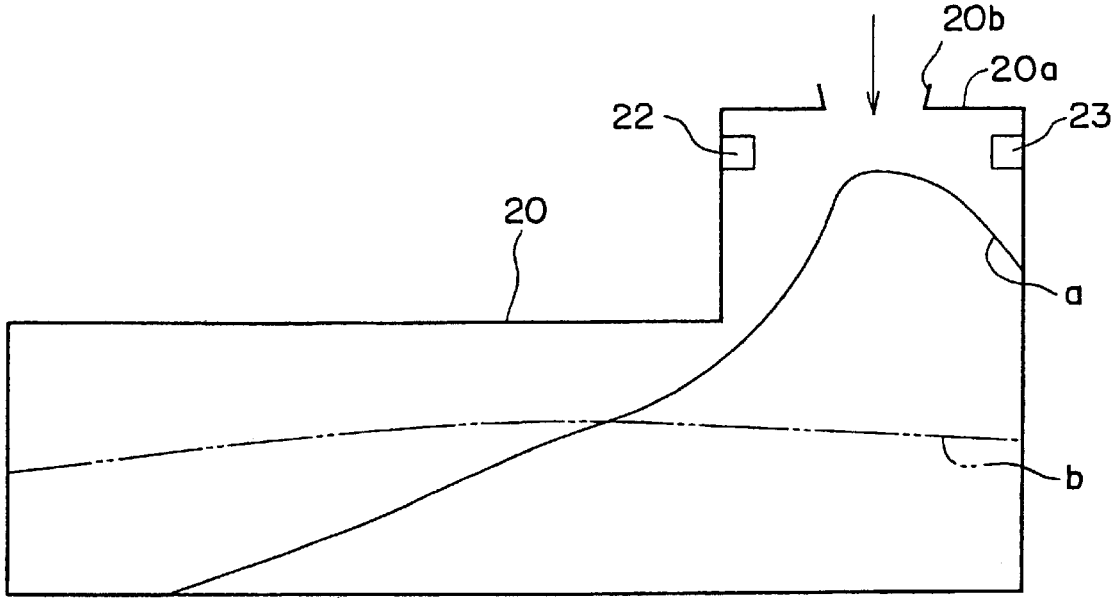
FIG. 5 is an illustration showing the state that a waste toner accumulates in a waste toner box.

FIG. 5 shows the state that a waste toner accumulates in a waste toner box. As described above, since the accumulation of the waste toner is carried out by the natural drop via the opening 20*b*, the waste toner is sequentially accumulating in the waste toner box, so that the accumulation has a substantially conical shape as shown by a curved solid line a.

Therefore, if the top end of the accumulation approaches the opening 20*b* as shown in FIG. 5, the waste toner can not further accumulate although a space for accumulation remains as a whole.

To solve this problem, conventionally, a sensor comprising a light emitting element 22 and a light receiving element 23 are provided for monitoring the filling state of the toner. If it is detected by the sensor that the height of the accumulation of the waste toner exceeds a predetermined height, an alarm is produced to allow the operator to shake the waste toner box 20 or the like to flatten the top of the waste toner as shown by a curved line b, or to continue a copying operation after the waste toner box is exchanged.

In addition, conventionally, it is supposed that the waste toner box is not frequently exchanged, and the waste toner box must have a large capacity since the above-described accumulation of the toner is carried out. This deteriorates the degree of freedom of design, or prevents the downsizing of the system.

In contrast, according to the present invention, it is a general rule that the toner cartridge and the waste toner box are exchanged simultaneously, and the toner cartridge and the waste toner box are provided in a pair as maintenance components.

By employing such providing system, users tend to avoid use of uncertified toner cartridge considering complex operation, which results in increase of use rate of certified cartridge.

In this case, the capacity of the waste toner box is preferably half of the capacity of the toner cartridge. If it is such a capacity, it is possible to carry out an efficient operation by exchanging the waste toner box simultaneously with the exchange of the toner cartridge when the toner cartridge is empty.

Furthermore, by such a simultaneous exchange, it is not required to detect the amount of the waste toner in the waste toner box, so that it is possible to reduce costs.

Figure 6A:
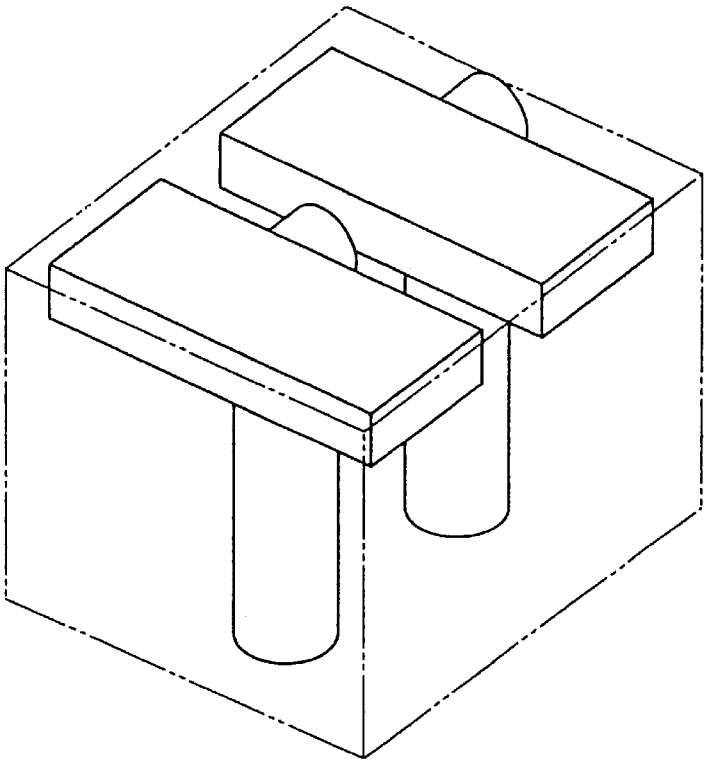
FIG. 6A PRIOR ART
FIG. 6A is a perspective view showing packing status of conventional combined type toner cartridges and waste toner cartridges.
Figure 6B:
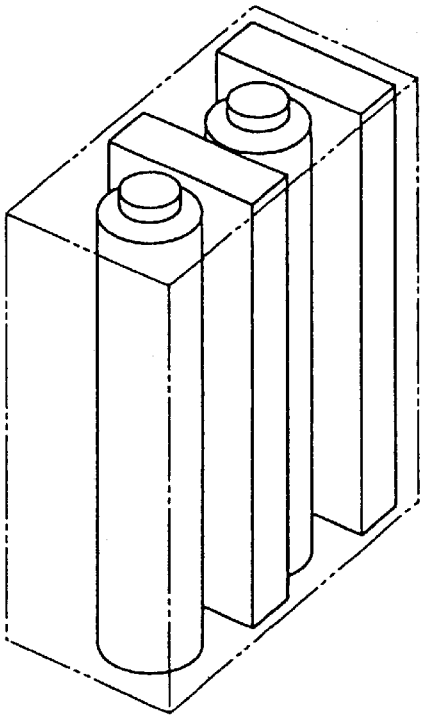
FIG. 6B is a perspective view showing packing status of toner cartridges and waste toner cartridges according to the present invention.

Still further, in the case of conventional fixed type toner cartridge, if a toner cartridge and a waste toner box are integrated, its packing size is large as shown in FIG. 6A. In contrast, as shown in the above-mentioned embodiment, by employing a rotation type toner cartridge and a waste toner box are separately mounted and simultaneously exchanged, its packing size can be considerably reduced, because both can be arranged so that their longitudinal directions are the same. In this case, by making the waste toner box of flexible material such as plastic, with a restraint member for restricting free movement of the toner cartridge, the waste toner box can be used as a part of packing material.

Next, with the above-described constructions, the operation from exchange of the toner cartridge to the supply of the toner will be described in detail below.

First, the user opens a front cover which is provided on the front surface of the image forming part 80 and which is capable of being open and closed, detaches the waste toner box 20 mounted on the front surface, and extracts the empty toner cartridge 16. Then, the user attaches a new toner cartridge 16, which has been prepared, on the toner supply device 7, attaches a new waste toner box, which is a companion to the toner cartridge, at a predetermined position, and closes the front cover.

When the new toner cartridge 16 is attached, the copying machine 1 determines whether the attached toner cartridge 16 is a certified product before a toner supply operation is carried out.

Specifically, the toner cartridge 16 is rotated by the rotating unit 19 of the toner supply part 18 counterclockwise B, i.e., in the opposite direction to the rotational direction A during supply, by two revolutions or more. Thus, the optical sensor 40 reads information recorded on the discriminating label. At this time, if the discriminating label is not applied on the toner cartridge 16 or if information different from a desired specification is recorded on the applied discriminating label, the copying machine 1 determines that the attached toner cartridge 16 is a non-certified product, so that the copying machine 1 is stopped.

The determined result indicative of the non-certified product may be displayed on a control panel so as to be given to the user, or may be derived only by a field engineer by inputting a predetermined service code. In addition, if the operating condition of the copying machine can be remote-controlled using a communication line or the like, information relating to the determined result may be transmitted to a control computer of a service center to be communicated to a field engineer, an agent in charge of the user, or a salesman.

Furthermore, when the non-certified toner cartridge 16 is attached, the blocking plate member 21 of the waste toner box 20 interferes with the front surface of the toner cartridge 16 to prevent the toner cartridge 16 from being attached, or the waste toner box can not oscillate since the toner cartridge does not have any protruding portions which are engageable with the protruding portion of the waste toner box 20. Thus, the non-certified toner cartridge 16 can be found.

The cleaning part 301 cleans the surface of the discriminating label to remove dust, such as toner and paper powder, which adheres thereto, before the reading operation of the optical sensor 40.

When the optical sensor 40 reads the fact that the information recorded on the discriminating label is coincident with the condition of the specification, the copying machine 1 determines that the attached toner cartridge 16 is a certified product, and ends the above-described discriminating operation.

Then, the toner supply device 7 carries out an operation of agitating the toner in the toner cartridge 16 before the toner is supplied to the developing device 11. That is, the rotating unit 19 rotates the toner cartridge 16 about a position, at which the discriminating label is applied, alternately clockwise A and counterclockwise B by predetermined angles, respectively.

Since such an oscillating operation can break lumps of the toner if the toner has gathered in the toner cartridge 16 in a preservation period and/or in a state of preservation, the amount of the toner subsequently supplied can be stabilized. Thus, it is not required to carry out the agitating operation for the toner cartridge 16, which has been conventionally carried out by the user before attaching the toner cartridge 16, so that it is possible to relieve the user's work load.

Thereafter, the above-described toner supply operation is carried out.

While the preferred embodiments of the present invention have been described above, the present invention should not be limited thereto, but the invention can be embodied in various ways without departing from the principle of the invention.

For example, in the above-mentioned embodiment, a blocking plate member for blocking removal of a toner cartridge is provided on a waste toner box. But any construction in which a toner cartridge can be removed when both elements are in predetermined positions or in predetermined combination form can be employed without being limited to the embodiment.

Furthermore, in the above-described embodiment, an application to digital copier is described. But this invention is not limited to such embodiment, and can be applied to conventional copier or laser printer, etc. The copying machine may be a monochromatic (e.g. black) color printer, or color system using a plurality of color toners. Further, in the case of digital copier, data supplied by a computer (personal computer, mini computer, etc.) as alternative data from the image reading part, or selected data from one of the data supplied by the computer and the data obtained by the image reading part is taken in as image signals.

What is claimed is:

1. An image forming system comprising:

a developing device for causing a toner to adhere to a latent image, which is formed on a photosensitive material drum, to form a visible image;

a toner supply device for supplying a toner, which is housed in a toner container, to said developing device;

a toner removing device for removing a remaining toner after said visible image on said photosensitive material drum is transferred to a transfer paper;

a waste toner container for accumulating therein a waste toner removed by said toner removing device; and a restraint member for enabling attaching and detaching said toner container when said toner container and said waste toner container take predetermined positions.

2. The image forming system according to claim 1, wherein said restraint member is a plate member which blocks said toner container to move after it is attached in a predetermined position.

3. The image forming system according to claim 1, wherein said restraint member includes an engaging member which engages only with a certified toner container.

4. A waste toner container for use in an image forming system comprising:

a developing device for causing a toner to adhere to a latent image, which is formed on a photosensitive material drum, to form a visible image;

a toner supply device for supplying a toner, which is housed in a toner container, to said developing device; and a toner removing device for removing a remaining toner after said visible image on said photosensitive material drum is transferred to a transfer paper, said waste toner container accumulating therein a waste toner removed by said toner removing device, wherein said waste toner container has a restraint member for blocking movement of the toner container which has been in a predetermined position, when said toner container is attached in a predetermined position.

5. The waste toner container according to claim 4, wherein said restraint member is a plate member located on the detaching direction of the toner container.

6. The waste toner container according to claim 4, wherein capacity of the waste toner container is approximately a half of the toner container.

7. The waste toner container according to claim 4, wherein said waste toner container is separated from the toner container but these are packed as a pair.

8. A toner container for use in an image forming system comprising:

a developing device for causing a toner to adhere to a latent image, which is formed on a photosensitive material drum, to form a visible image;

a toner supply device for supplying a toner, which is housed in a toner container, to said developing device; and a toner removing device for removing a remaining toner after said visible image on said photosensitive material drum is transferred to a transfer paper, a waste toner container accumulating therein waste toner removed by said toner removing device, wherein movement of said toner container is blocked by a restraint member of the waste toner container when the toner container has been in a predetermined position.

9. The toner container according to claim 8, wherein said restraint member is a plate member located on the detaching direction of the toner container.

10. The toner container according to claim 8, wherein capacity of the toner container is approximately double of the waste toner container.

11. The toner container according to claim 8, wherein said toner container is separated from the waste toner container but these are packed as a pair.

12. A toner container for use in a toner supply device for supplying toner to an image forming system for forming arbitrary images including characters and figures, wherein detaching of said toner container is blocked by a waste toner container for accumulating excessive toner in the image forming system, when the toner container is attached to the toner supply device.

13. The toner container according to claim 12, wherein at a part of said toner container, rotating power for rotating the connected toner container is supplied from the image forming system, when the toner container is attached to the image forming system.

* * * * *